US007077791B2

(12) United States Patent
Krull

(10) Patent No.: US 7,077,791 B2
(45) **Date of Patent: *Jul. 18, 2006**

(54) WEIGHT SELECTION METHODS AND APPARATUS

(75) Inventor: Mark A. Krull, Bend, OR (US)

(73) Assignee: Mautilus, Inc., Vancouver, WA (US)

( * ) Notice: Subject to any disclaimer, the term of this patent is extended or adjusted under 35 U.S.C. 154(b) by 428 days.

This patent is subject to a terminal disclaimer.

(21) Appl. No.: 10/127,049

(22) Filed: Apr. 18, 2002

(65) Prior Publication Data

US 2003/0199368 A1 Oct. 23, 2003

(51) Int. Cl.
*A63B 21/075* (2006.01)

(52) U.S. Cl. ..... 482/108; 482/98; 482/107

(58) Field of Classification Search ..... 482/106–108, 482/93, 94, 98
See application file for complete search history.

(56) References Cited

U.S. PATENT DOCUMENTS

| | | | | |
|---|---|---|---|---|
| 772,906 | A | 10/1904 | Reach | |
| 848,272 | A | 3/1907 | Thornley | |
| 1,053,109 | A | 2/1913 | Reach | |
| 1,422,888 | A | 7/1922 | Reeves et al. | |
| 1,672,944 | A | 6/1928 | Jowett | |
| 1,779,594 | A | 10/1930 | Hall | |
| 1,917,566 | A | 7/1933 | Wood | |
| 3,647,209 | A | 3/1972 | La Lanne | |
| 3,758,109 | A | 9/1973 | Bender | |
| 3,771,785 | A | 11/1973 | Speyer | |
| 3,825,253 | A | 7/1974 | Speyer | |
| 3,912,261 | A | 10/1975 | Lambert, Sr. | |
| 3,913,908 | A | 10/1975 | Speyer | |
| D244,628 | S | 6/1977 | Wright | |
| 4,029,312 | A | 6/1977 | Wright | |
| 4,076,236 | A | 2/1978 | Ionel | |
| 4,349,192 | A | 9/1982 | Lambert, Jr. et al. | |
| RE31,113 | E | 12/1982 | Coker et al. | |
| 4,411,424 | A | 10/1983 | Barnett | |
| 4,453,710 | A | 6/1984 | Plötz | |
| 4,529,197 | A | 7/1985 | Gogarty | |
| 4,529,198 | A * | 7/1985 | Hettick, Jr. | 482/104 |
| 4,538,805 | A | 9/1985 | Parviainen | |
| 4,540,171 | A | 9/1985 | Clark et al. | |
| 4,546,971 | A | 10/1985 | Raasoch | |

(Continued)

FOREIGN PATENT DOCUMENTS

| | | |
|---|---|---|
| CH | 384485 | 11/1964 |

(Continued)

OTHER PUBLICATIONS

UK fitness supplies.co.uk, located at http://www.ukfitness-supplies.co.uk, 3 pages (First publ. date unknown, website pages printed on Aug. 4, 2003).

*Primary Examiner*—Gregory L. Huson
*Assistant Examiner*—Fenn C. Mathew
(74) *Attorney, Agent, or Firm*—Dorsey & Whitney LLP

(57) ABSTRACT

An exercise dumbbell has at least one weight selector that is rotatable into engagement with various combination of weights at opposite ends of the handle. On a first embodiment, first and second weight selectors are rotatably mounted on opposite ends of a bar for independent rotation relative to the handle. On a second embodiment, first and second weight selectors are keyed to a common bar and rotated together therewith relative to the handle.

21 Claims, 13 Drawing Sheets

U.S. PATENT DOCUMENTS 4,566,690 A 1/1986 Schook
4,568,078 A 2/1986 Weiss
4,575,074 A 3/1986 Damratoski
4,601,466 A 7/1986 Lais
4,624,457 A 11/1986 Silberman et al.
4,627,615 A 12/1986 Nurkowski
4,627,618 A 12/1986 Schwartz
4,651,988 A 3/1987 Sobel
4,712,793 A 12/1987 Harwick et al.
4,730,828 A 3/1988 Lane
4,743,017 A 5/1988 Jaeger
4,768,780 A 9/1988 Hayes
4,787,629 A 11/1988 DeMyer
4,809,973 A 3/1989 Johns
4,822,034 A * 4/1989 Shields ..... 482/106
4,834,365 A 5/1989 Jones
4,878,662 A 11/1989 Chern
4,878,663 A 11/1989 Luquette
4,880,229 A 11/1989 Broussard
4,900,016 A 2/1990 Caruthers
4,900,018 A 2/1990 Ish, III et al.
D307,168 S 4/1990 Vodhanel
4,913,422 A 4/1990 Elmore et al.
4,948,123 A 8/1990 Schook
4,971,305 A 11/1990 Rennex
4,982,957 A 1/1991 Shields
D315,003 S 2/1991 Huang
5,000,446 A 3/1991 Sarno
5,037,089 A 8/1991 Spagnuolo et al.
5,040,787 A 8/1991 Brotman
D321,230 S 10/1991 Leonesio
5,102,124 A 4/1992 Diodati
5,123,885 A 6/1992 Shields
5,131,898 A 7/1992 Panagos
5,135,453 A 8/1992 Sollenberger
D329,563 S 9/1992 Rasmussen
5,171,199 A 12/1992 Panagos
5,221,244 A 6/1993 Doss
5,263,915 A 11/1993 Habing
5,284,463 A 2/1994 Shields
5,306,221 A 4/1994 Itaru
5,344,375 A 9/1994 Cooper
5,374,229 A 12/1994 Sencil
5,407,413 A 4/1995 Kupferman
D359,778 S 6/1995 Towley, III et al.
5,433,687 A 7/1995 Hinzman et al.
5,435,800 A 7/1995 Nelson
D362,776 S 10/1995 Thorn
5,484,367 A 1/1996 Martinez
5,607,379 A 3/1997 Scott
5,628,716 A 5/1997 Brice
5,630,776 A 5/1997 Yang
5,637,064 A 6/1997 Olson et al.
5,669,861 A 9/1997 Toups
5,749,814 A 5/1998 Chen
5,769,762 A 6/1998 Towley, III et al.
5,776,040 A 7/1998 Webb et al.
5,779,604 A 7/1998 Towley, III et al.
5,839,997 A 11/1998 Roth et al.
5,853,355 A 12/1998 Standish
5,876,313 A 3/1999 Krull
5,879,274 A 3/1999 Mattox
5,971,899 A 10/1999 Towley, III et al.
6,033,350 A 3/2000 Krull
6,039,678 A 3/2000 Dawson
D422,654 S 4/2000 Chen
6,083,144 A 7/2000 Towley, III et al.
6,099,442 A 8/2000 Krull
6,123,651 A 9/2000 Ellenburg
6,149,558 A 11/2000 Chen
6,186,927 B1 2/2001 Krull
6,186,928 B1 2/2001 Chen
6,196,952 B1 * 3/2001 Chen ..... 482/107
6,228,003 B1 * 5/2001 Hald et al. ..... 482/107
6,261,022 B1 7/2001 Dalebout et al.
6,261,211 B1 7/2001 Suarez et al.
6,322,481 B1 11/2001 Krull
6,328,678 B1 12/2001 Romero
6,350,221 B1 2/2002 Krull
6,402,666 B1 6/2002 Krull
6,416,446 B1 7/2002 Krull
6,422,979 B1 * 7/2002 Krull ..... 482/98
6,461,282 B1 10/2002 Fenelon
6,500,101 B1 12/2002 Chen
D468,946 S 1/2003 Harms et al.
D469,294 S 1/2003 Harms et al.
6,540,650 B1 4/2003 Krull
6,582,345 B1 6/2003 Roy
6,629,910 B1 10/2003 Krull
6,656,093 B1 12/2003 Chen
6,669,606 B1 12/2003 Krull
6,679,816 B1 1/2004 Krull
6,682,464 B1 1/2004 Shifferaw
6,719,672 B1 4/2004 Ellis et al.
6,719,674 B1 4/2004 Krull
6,733,424 B1 5/2004 Krull
6,746,381 B1 6/2004 Krull
6,749,547 B1 * 6/2004 Krull ..... 482/106
D498,272 S 11/2004 Sanford-Schwentke et al.
D500,820 S 1/2005 Krull
6,855,097 B1 2/2005 Krull
6,872,173 B1 3/2005 Krull
6,902,516 B1 6/2005 Krull
D508,628 S 8/2005 Crawford et al.
2002/0107118 A1 8/2002 Shifferaw
2002/0115539 A1 8/2002 Krull
2002/0183174 A1 12/2002 Chen
2003/0148862 A1 8/2003 Chen et al.
2003/0153439 A1 8/2003 Krull
2003/0199369 A1 10/2003 Krull
2004/0005968 A1 1/2004 Crawford et al.
2004/0005969 A1 1/2004 Chen
2004/0023765 A1 2/2004 Krull
2004/0072661 A1 4/2004 Krull
2004/0138031 A1 7/2004 Krull
2005/0079961 A1 4/2005 Dalebout et al.

FOREIGN PATENT DOCUMENTS

EP 177643 4/1986
FR 637365 4/1928
FR 1468902 4/1967
FR 2452296 10/1980
FR 2613237 10/1988
JP 10118222 5/1998
SU 1258447 9/1986
SU 1367987 1/1988
SU 1389789 A2 4/1988
SU 1643024 4/1991
SU 1659073 6/1991
SU 1687271 10/1991
SU 1780780 12/1992
WO 03/063969 A2 8/2003
WO 03/063969 A3 8/2003
WO 03/089070 A1 10/2003

* cited by examiner

Fig. 7
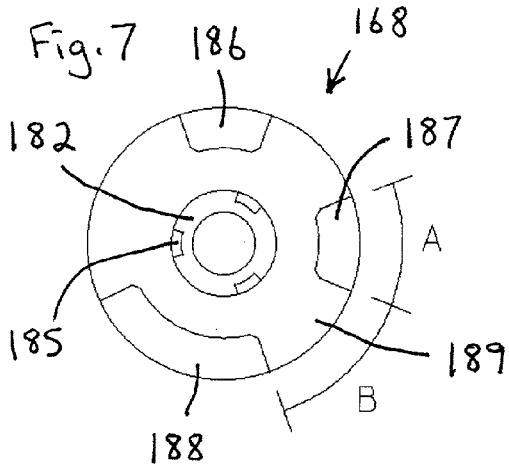
Fig. 10
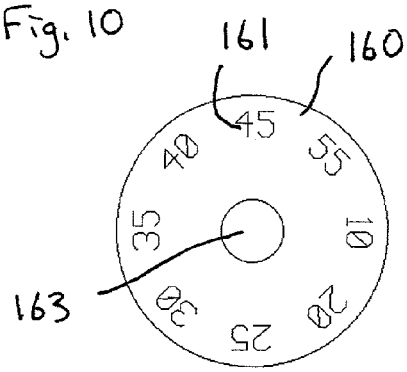
Fig. 8
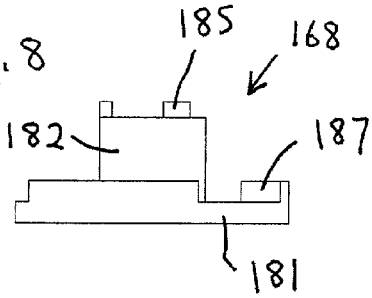
Fig. 11
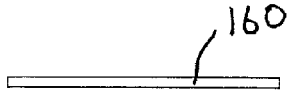
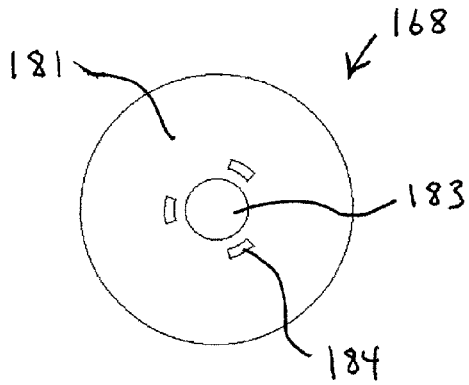
Fig. 9
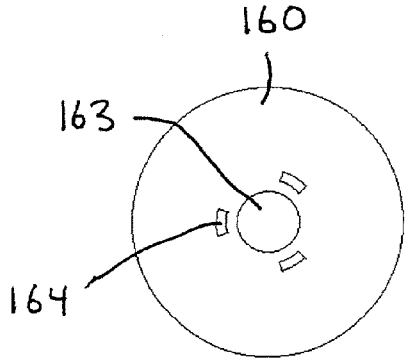
Fig. 12

169
168
167
160
20
25
30
35
40
45
55
10

169
168
167
160
25
30
35
40
45
55
10
20

169
168
167
160
30
35
40
45
55
10
20
25

169
168
167
160
35
40
45
55
10
20
25
30

169
168
167
160
40
45
55
10
20
25
30
35

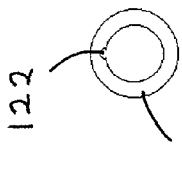
Fig. 26
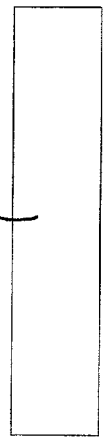
Fig. 25
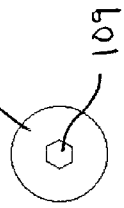
Fig. 27
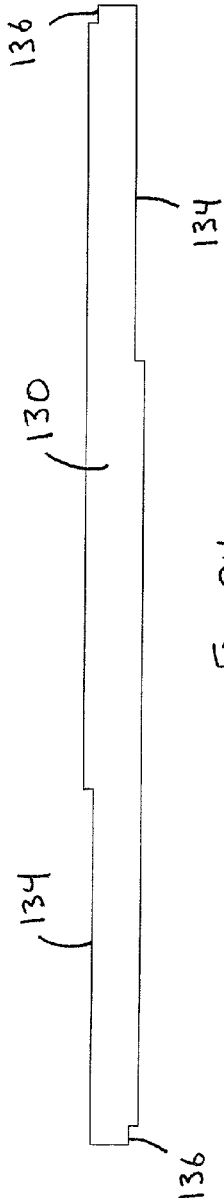
Fig. 24
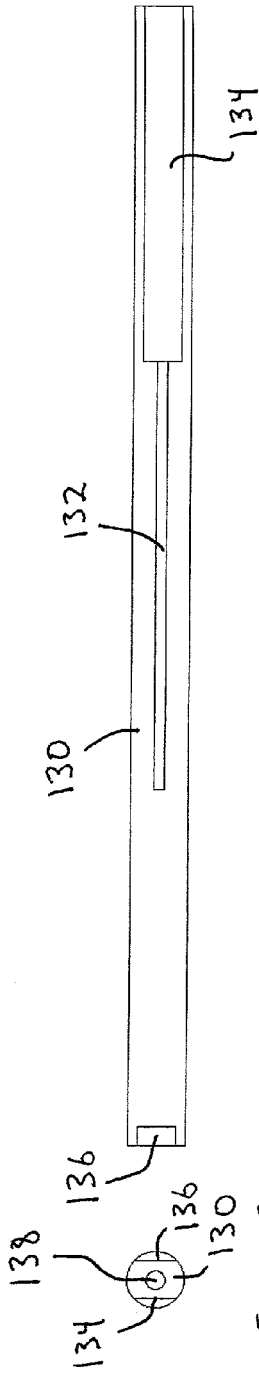
Fig. 22
Fig. 23

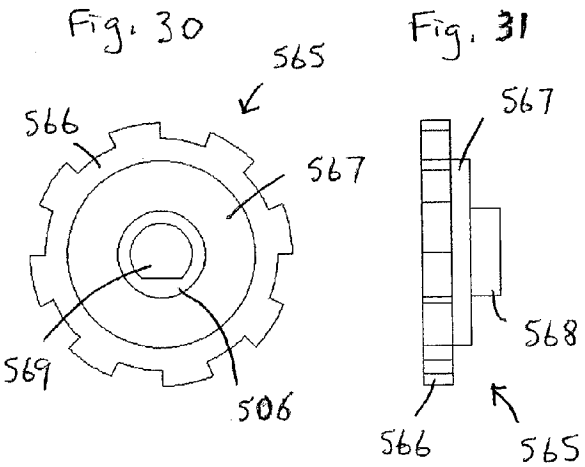
Fig. 30
Fig. 31
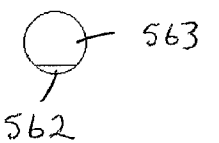
Fig. 33
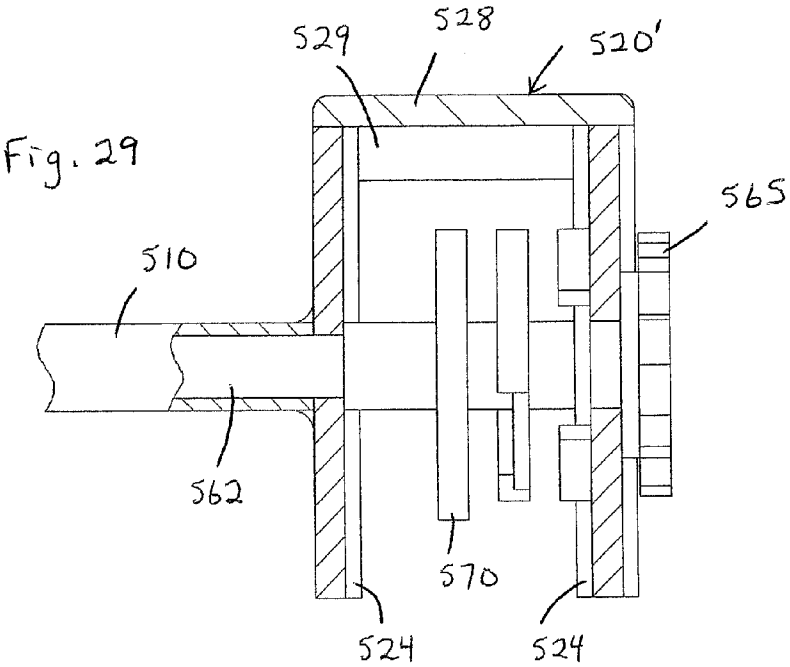
Fig. 29
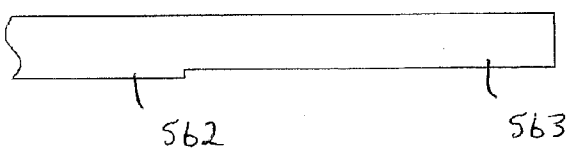
Fig. 32

WEIGHT SELECTION METHODS AND APPARATUS

FIELD OF THE INVENTION

The present invention relates to exercise equipment and more particularly, to weight selection methods and apparatus for free weights such as dumbbells and barbells.

BACKGROUND OF THE INVENTION

Various weight selection methods and apparatus have been developed to provide adjustable resistance to exercise. With respect to free weights, weight plates are typically mounted on opposite ends of a bar. In relatively advanced systems, the bar or handle assembly is stored in proximity to the weight plates, and at least one selection mechanism is provided to connect a desired amount of mass to the bar.

Some examples of patented barbell/dumbbell improvements and/or features are disclosed in U.S. Pat. No. 4,529,198 to Hettick, Jr. (discloses a barbell assembly having opposite end weights that are maintained in alignment on respective storage members and selectively connected to a handle by means of axially movable springs); U.S. Pat. No. 4,822,034 to Shields (discloses both barbell and dumbbell assemblies having opposite end weights that are maintained in alignment on a shelf and selectively connected to a handle by means of latches on the weights); U.S. Pat. No. 5,284,463 to Shields (discloses a dumbbell assembly having opposite end weights that are maintained in alignment on a base and selectively connected to a handle by means of cam driven pins on the weights); U.S. Pat. No. 5,637,064 to Olson et al. (discloses a dumbbell assembly having a plurality of interconnected opposite end weights that are stored in nested relationship to one another and selectively connected to a handle by means of a U-shaped pin); U.S. Pat. No. 5,769,762 to Towley, III et al. (discloses a dumbbell assembly having a plurality of interconnected opposite end weights that are stored in nested relationship to one another and selectively connected to a handle by various means); U.S. Pat. No. 5,839,997 to Roth et al. (discloses a dumbbell assembly having opposite end weights that are maintained in alignment on a base and selectively connected to a handle by means of eccentric cams on a rotating selector rod); and U.S. Pat. No. 6,033,350 to Krull (discloses a dumbbell assembly having opposite end weights that are maintained in alignment on a base and selectively connected to a handle by means of respective first and second selector rods that move axially in opposite directions). Despite these advances and others in the field of weight selection, room for improvement and continued innovation remains.

SUMMARY OF THE INVENTION

The present invention provides weight selectors that occupy spaces between adjacent weights and rotate through a range of orientations to alternatively engage and disengage various combinations of the weights. Each weight selector is configured to engage any combination of at least two weights. Many features and advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

FIG. 7 is an end view of a weight engagement member on the dumbbell of FIG. 1;

FIG. 8 is a side view of the weight engagement member of FIG. 7;

FIG. 9 is an opposite end view of the weight engagement member of FIG. 7;

FIG. 10 is an end view of a weight indicator on the dumbbell of FIG. 1;

FIG. 11 is a side view of the weight indicator of FIG. 10;

FIG. 12 is an opposite end view of the weight indicator of FIG. 10;

FIG. 22 is a side view of a bar on the dumbbell of FIG. 1;

FIG. 23 is an end view of the bar of FIG. 22;

FIG. 24 is a top view of the bar of FIG. 22;

FIG. 25 is a side view of a handle on the dumbbell of FIG. 1;

FIG. 26 is an end view of the handle of FIG. 25;

FIG. 27 is an end view of a fastener on the dumbbell of FIG. 1;

FIG. 29 is partially sectioned side view of one end of the dumbbell of FIG. 28;

FIG. 30 is an end view of a knob on the dumbbell of FIG. 28;

FIG. 31 is an opposite side view of the knob of FIG. 30;

FIG. 32 is a side view of one end of a shaft on the dumbbell of FIG. 28;

FIG. 33 is an end view of the shaft of FIG. 32;

DETAILED DESCRIPTION OF THE PREFERRED EMBODIMENT

The present invention provides methods and apparatus to facilitate adjustment of weight resistance to exercise motion. Generally speaking, the present invention allows a person to adjust weight resistance by rotating one or more weight selectors into engagement with a desired combination of weights.

Figure 1:
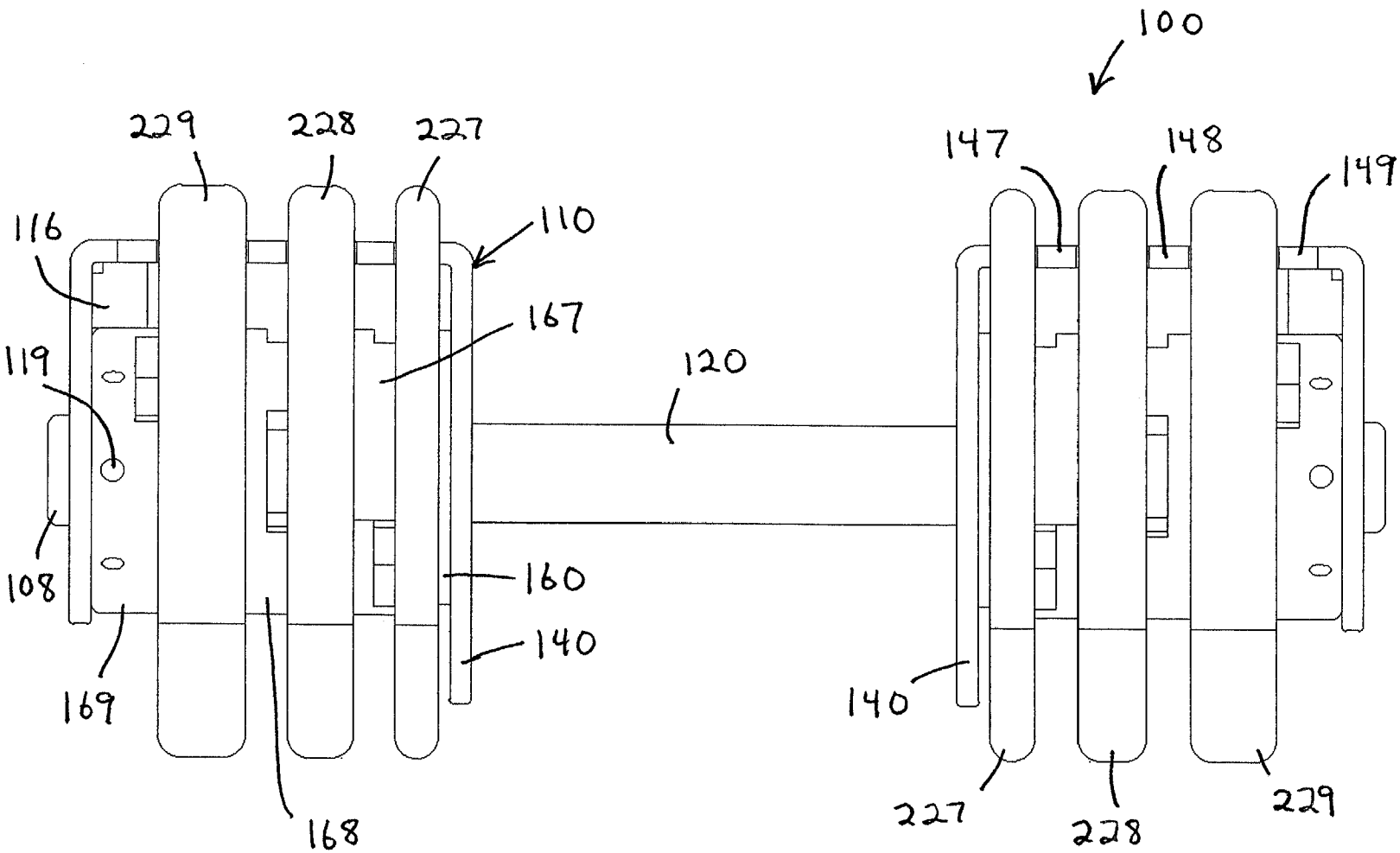
FIG. 1 is a side view of an exercise dumbbell constructed according to the principles of the present invention.

FIG. 1 shows an exercise dumbbell 100 constructed according to the principles of the present invention. The dumbbell 100 includes a handle assembly 110 and a plurality of weight plates 227–229 that are selectively connected to the handle assembly 110.

Figure 2:
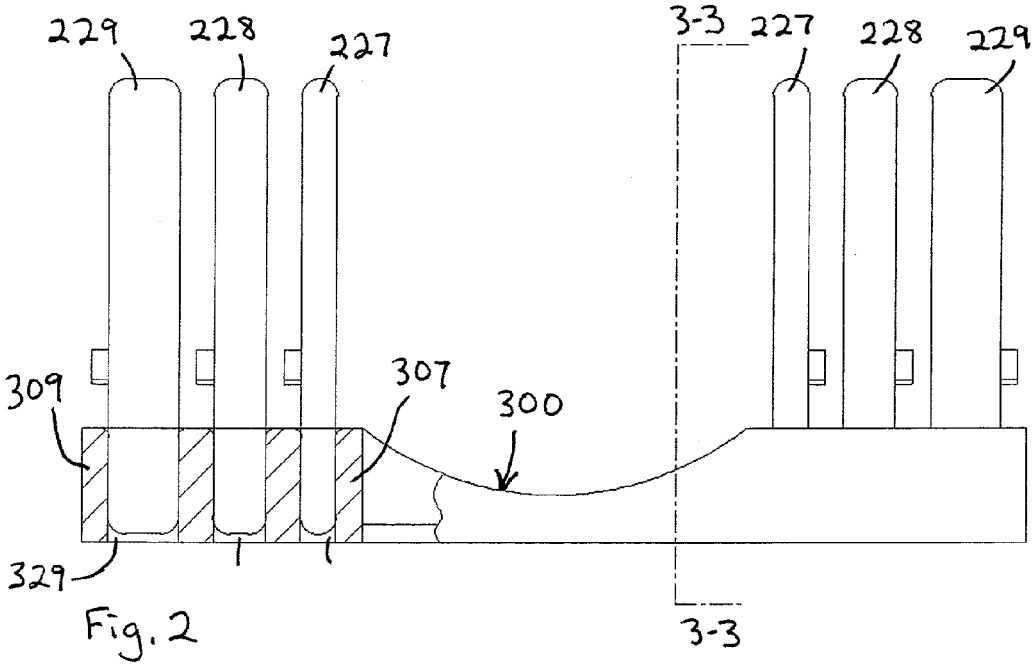
FIG. 2 is a partially sectioned side view of a weight base and a plurality of weight plates suitable for use with the dumbbell of FIG. 1.
Figure 3:
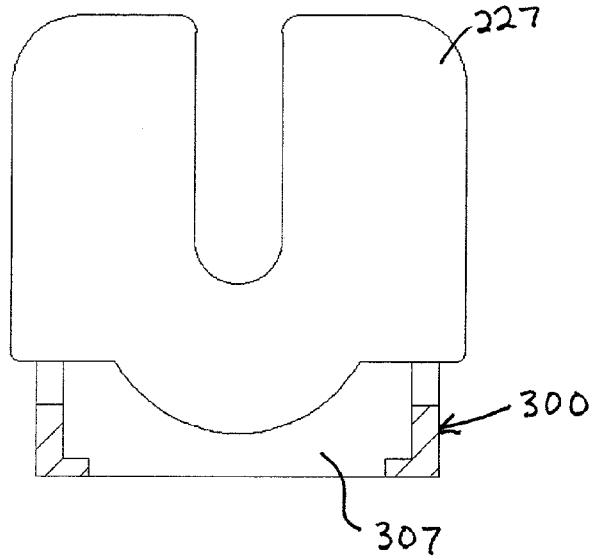
FIG. 3 is a sectioned end view of the weight base and weights of FIG. 2.

As shown in FIG. 2, the weight plates 227–229 rest on a weight base or cradle 300 when not in use. The base 300 is preferably an injection molded plastic member having an intermediate portion, and respective weight storage areas at opposite ends of the intermediate portion. Each weight storage area is defined by a plurality of side walls, end walls, and spacers which cooperate to define discrete weight upwardly opening slots or compartments 327–329. The upper corners on these walls and spacers are preferably beveled and/or rounded to help guide the weight plates 227–229 into place. Also, each end wall 307 and 309 is preferably contoured or notched (as shown in FIG. 3) for reasons discussed below. The depicted base 300 does not require a bottom wall because of the manner in which the weight plates 227–229 are configured, but the present invention is not limited to such an arrangement. Some other weight storage arrangements are disclosed in U.S. Pat. No. 4,529,198 to Hettick, Jr.; U.S. Pat. No. 4,822,034 to Shields; U.S. Pat. No. 5,284,463 to Shields; U.S. Pat. No. 5,839,997 to Roth et al.; and U.S. Pat. No. 6,033,350 to Krull, all of which are incorporated herein by reference.

Figure 6:
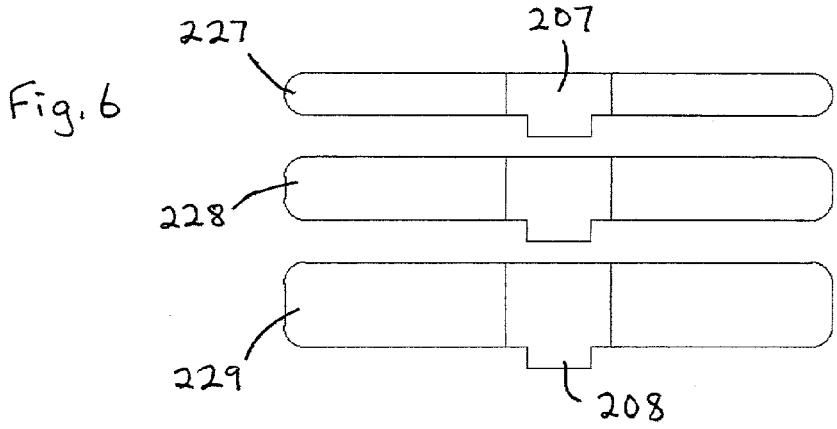
FIG. 6 is a top view of the weight plates of FIG. 4.
Figure 5:
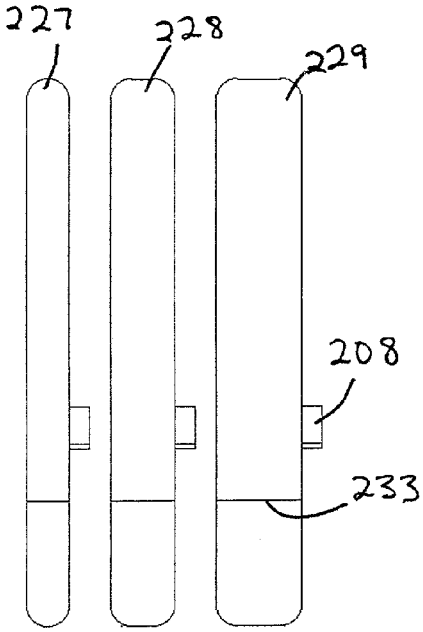
FIG. 5 is a side view of the weight plates of FIG. 4.
Figure 4:
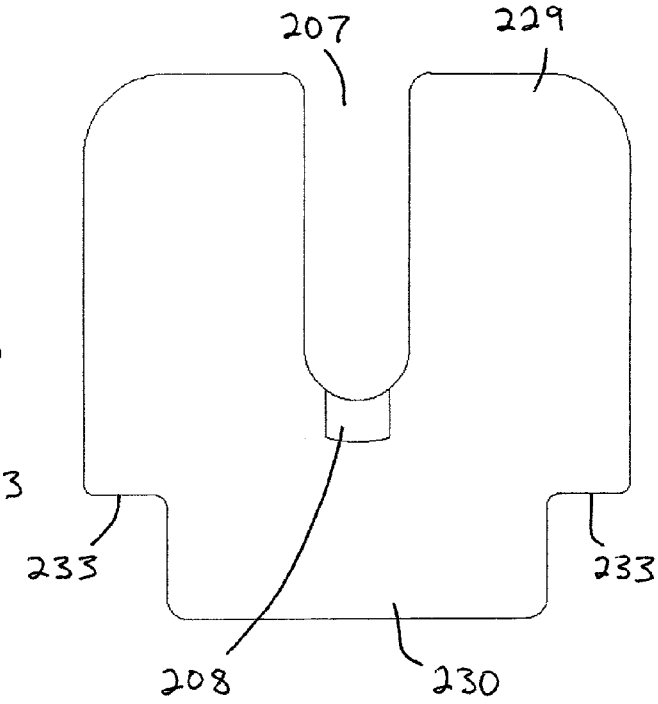
FIG. 4 is an end view of the weight plates of FIG. 3 without the weight base.

FIGS. 4–6 show one group of weight plates 227–229 by themselves, though arranged as if supported by the base 300. With the exception of thickness, the weight plates 227–229 are identical to one another. The weight plates 227–229 are preferably made of steel. For the dumbbell 100, the weight plates 227 are configured to weigh five pounds each; the weight plates 228 are configured to weigh seven and one-half pounds each; and the weight plates 229 are configured to weigh ten pounds each. Those skilled in the art will recognize that different weight amounts may be selected as a matter of design choice. In this particular case, the selected weights are deemed a desirable choice for reasons discussed below.

As shown in FIGS. 4–6, each of the weight plates 227–229 has an upwardly opening slot 207, and a peg or nub 208 that is disposed immediately beneath the slot 207 and protrudes orthogonally outward from the plate. The lower corners of each plate 227–229 are notched to provide a relatively narrower lower end 230, and laterally extending, downwardly facing shoulders 233 on opposite sides thereof. These notches tend to offset the impact of the slot 207 for purposes of maintaining proximity between the center of mass and the geometric center of the weight plate. Also, the narrow end 230 is configured to fit inside a respective slot 327–329 in the base 300, and the shoulders 233 are configured to rest on respective sidewalls of the base 300, thereby eliminating the need for a bottom wall. This arrangement also reduces the size of the base 300 relative to the size of the weight plates 227–229. The weight plates 227–229 preferably have rounded corners to eliminate sharp edges and to facilitate both insertion of the weight plates 227–229 into the base 330 and insertion of the handle assembly 110 into the weight plates 227–229.

The handle assembly 110 includes an intermediate hand grip or handle 120 that is shown by itself in FIGS. 25–26. The handle 120 is preferably an extruded plastic member that may be described as a cylindrical tube. The exterior of the handle 120 may be knurled, contoured, and/or coated to facilitate a comfortable and reliable grip. The outside diameter defined by the tube is 1.125 inches, and the inside diameter defined by the tube is 0.75 inches. A groove or keyway 122 is provided along the internal sidewall of the hand 120, and the keyway 122 extends axially the length of the handle 120 (five and one-half inches).

The handle 120 is mounted on a bar 130 that is shown by itself in FIGS. 22–24. The bar 130 is preferably made of steel, and may be described as a modified cylindrical rod that defines a longitudinal axis. An intermediate portion of the bar 130 is five and one-half inches long and defines an outside diameter of 0.75 inches. In other words, the handle 120 is configured to fit snugly onto the intermediate portion of the bar 130. A groove or keyway 132 extends axially along the intermediate portion of the bar 130, which is otherwise cylindrical in shape. The groove 132 in the bar 130 is similar in size and shape to the groove 122 in the handle 120, and a pin or key (not shown) is inserted through the aligned grooves 122 and 132 to key the handle 120 against rotation relative to the bar 130. Other arrangements, including radially extending pins or screws may be used in the alternative to secure the handle 120 to the bar 130. Also, an alternative bar may be manufactured with the handle forming an integral portion thereof.

Opposite end portions of the bar 130 are provided with diametrically opposed flat surfaces 134 and 136. Each of the flat surfaces 134 extends axially along the entire length of a respective end portion (four and five-eighths inches), and each of the flat surfaces 136 extends only one-quarter inch inward from a respective distal end. One of the longer flat surfaces 134 is circumferentially aligned with the groove 132 and accommodates insertion of the key between the handle 120 and the bar 130. The other longer flat surface 134 is diametrically opposed.

The flat surfaces 134 and 136 on the bar 130 are configured to receive respective ends of respective brackets 140, one of which is shown by itself in FIGS. 18–21. Each bracket 140 is preferably a steel plate that has been bent into a U-shaped configuration, including an intermediate strip 141, an inside flange 142 having an elliptical shape, and an outside flange 145 having a rectangular shape. Prior to assembly of the dumbbell 100, the angles defined between the strip 141 and each of the flanges 142 and 145 are preferably slightly greater than ninety degrees for reasons discussed below.

A generally D-shaped opening 144 extends through the inside flange 142 and is configured to fit snugly onto either end portion of the bar 130 (because the longer flat surfaces 134 are diametrically opposed, and the shorter flat surfaces 136 are diametrically opposed). In other words, the inside flange 142 is slidable into abutment against either end of the intermediate portion of the bar 130. An opening 146 extends through the outside flange 145 and is configured to fit snugly onto either distal end of the bar 130 and into abutment against the remainder of the end portion. As discussed below, a weight indicator 160 and three weight engagement members 167–169 are mounted on each end portion of the bar 130 prior to a respective outside flange 145. The opening 146 is bounded by two diametrically opposed cylindrical surfaces and two diametrically opposed flat surfaces which cooperate to define an opening similar to the profile of the distal ends of the bar 130 (shown in FIG. 23). The openings 144 and 146 cooperate with the bar 130 to key the bracket 140 against rotation relative to the bar 130. Other arrangements, including welding or keying, may be used in the alternative.

Threaded holes 138 extend into respective distal ends of the bar 130 to receive respective fasteners 108, one of which is shown by itself in FIG. 27. Each fastener 108 may be described as a bolt having a threaded shaft (not shown) and a relatively larger diameter head. A tool receiving opening 108 is preferably provided in the head of the fastener 108 to facilitate tightening of the fastener relative to the bar 130 by means of a wrench or other appropriate tool. The fasteners 108 cooperate with the intermediate portion of the bar 130 to prevent axial movement of the brackets 140 and/or the weight engagement members 167–169. The slightly divergent configuration of the flanges 142 and 145 provides a spring washer sort of effect.

Each bracket 140 is configured to maintain the weight plates 227–229 in the same relative positions as the base 300. In this regard, the strip 141 is configured to fit inside the slots 207 in the weight plates 227–229, and three pairs of tabs 147–149 extend outward from opposite sides of the strip 141. The tabs 147 cooperate with the inside flange 142 to define a first weight slot 157 configured to accommodate the weight plate 227. The tabs 148 cooperate with the tabs 147 to define a second weight slot 158 configured to accommodate the weight plate 228. The tabs 149 cooperate with the tabs 148 to define a third weight slot 159 configured to accommodate the weight plate 229.

As noted previously, a weight indicator 160 and a group of three weight engagement members 167–169 are mounted on each end portion of the bar 130. One of the weight indicators 160 is shown by itself in FIGS. 10–12. Each weight indicator 160 is preferably an injection molded plastic disc. A circular hole 163 extends through the center of the indicator 160 and defines an inside diameter of slightly more than 0.75 inches. In other words, the indicator 160 is configured to be rotatably mounted on either end portion of the bar 130. Circumferentially spaced weight indicia 161 are provided on a first side of the indicator 160. The weight indicia 161 are arranged to appear one at a time through a window 143 in the inner flange 142 when the indicator 160 is properly positioned on the bar 130. Also, circumferentially spaced slits 164 are provided in an opposite, second side of the indicator 160 to facilitate a rotational link between the indicator 160 and the weight engagement members 167–169, as further discussed below.

FIGS. 7–9 shows one of the middle weight engagement members 168 by itself. Each weight engagement member 167–169 is preferably an injection molded plastic member that includes a disc portion 181 and an orthogonally projecting hub (designated as 182 on the weight engagement member 168). The disc portion 181 is similar in size and shape to the indicator 160, but twice as thick. The hub portion 182 is concentrically aligned with the disc portion 181 and configured both to fit inside the slot 207 in a respective weight plate 227–229, and to span the thickness of a respective weight plate 227–229.

A circular hole 183 extends through both the disc portion 181 and the hub 182 and defines an inside diameter of slightly more than 0.75 inches. In other words, the weight engagement members 167–169 are configured to be rotatably mounted on either end portion of the bar 130. Circumferentially spaced slits 184 are provided in the side of the disc portion 181 opposite the hub 182 to similarly facilitate a rotational link between the indicator 160 and the weight engagement members 167–169. In this regard, circumferentially spaced tabs 185 project outward from a distal end of the hub 182. The tabs 185 on the weight engagement member 168 are configured for insertion into the slits 184 in the adjacent weight engagement member 167. Similar tabs on the weight engagement member 167 are configured for insertion into the slits 164 in the weight indicator 160, and similar tabs on the weight engagement member 169 are configured for insertion into the slits 184 in the weight engagement member 168.

Each of the weight engagement members 167–169 has at least one lip portion that extends axially away from a radially outward portion of a respective disc portion 181. On each of the weight engagement members 167–169, the at least one lip portion spans a plurality of sectors disposed about the hub, leaving gaps in the remaining sectors. Each hub and its associated lip portion(s) cooperate to define a ring of space therebetween. This ring of space is configured to accommodate the nub 208 on a respective weight plate 227–229 when the hub is resting inside the slot 207 in the respective weight plate 227–229. In other words, the arrangement facilitates rotation of the lip portion(s) on the weight engagement members 167–169 about the nubs 208 on respective weight plates 227–229.

Each interconnected group of weight engagement members 167–169 cooperates to define a rotatable weight selector. On the dumbbell 100, each weight selector is selectively rotatable into eight different weight engaging orientations. For each of the weight engagement members 167–169, as well as the indicator 160, five of these available orientations are shown in FIGS. 13–17. An angle of forty-five degrees is defined between each successive orientation or sector.

Figures 13, 14, 15, 16, 17:
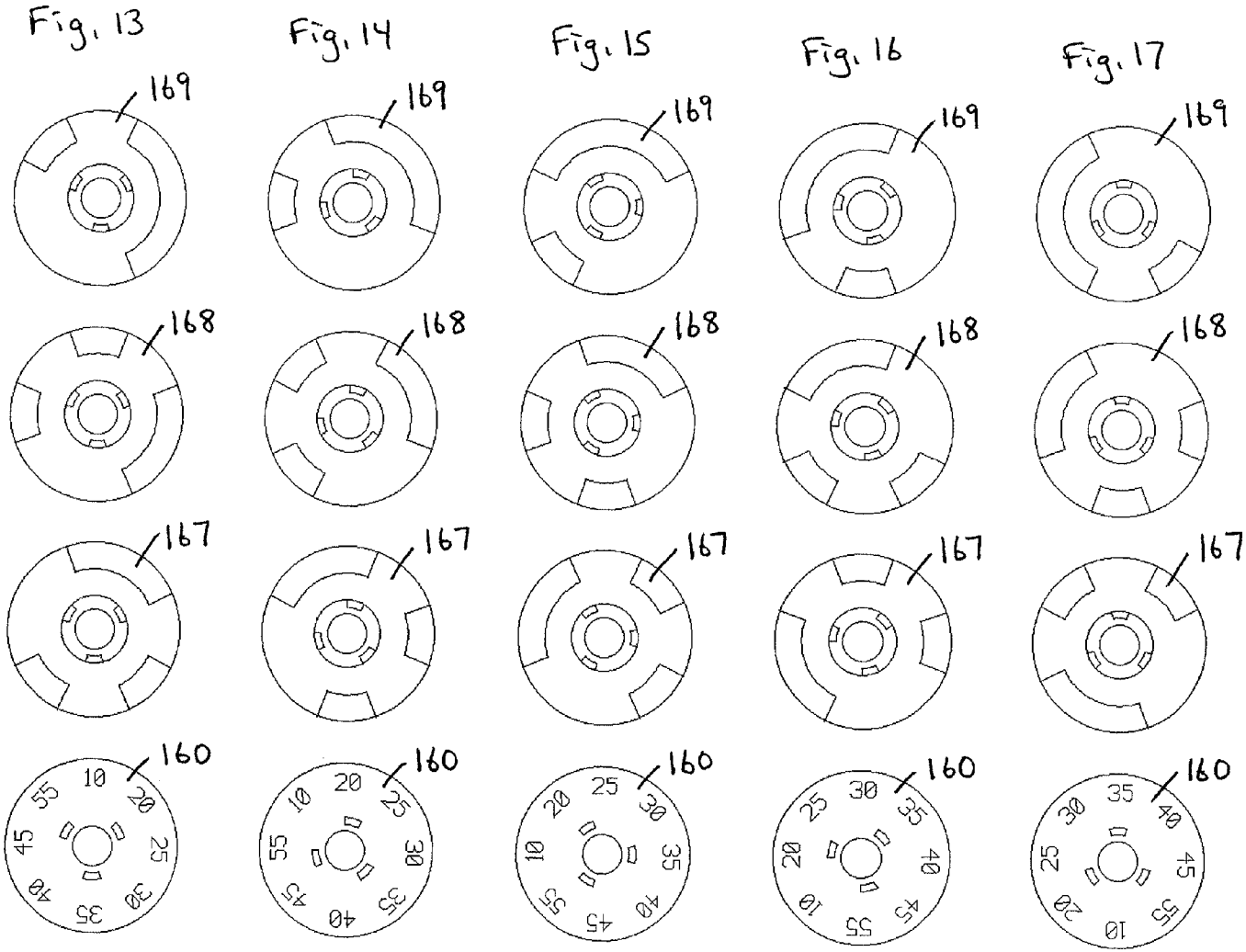
FIG. 13 is an exploded end view of the weight engagement member of FIG. 7, the weight indicator of FIG. 10, and two additional weight engagement members, as they occupy a first orientation on the dumbbell of FIG. 1.
FIG. 14 is an exploded view of the weight engagement members and weight indicator of FIG. 13, as they occupy a second orientation on the dumbbell of FIG. 1.
FIG. 15 is an exploded view of the weight engagement members and weight indicator of FIG. 13, as they occupy a third orientation on the dumbbell of FIG. 1.
FIG. 16 is an exploded view of the weight engagement members and weight indicator of FIG. 13, as they occupy a fourth orientation on the dumbbell of FIG. 1.
FIG. 17 is an exploded view of the weight engagement members and weight indicator of FIG. 13, as they occupy a fifth orientation on the dumbbell of FIG. 1.
Figure 20:
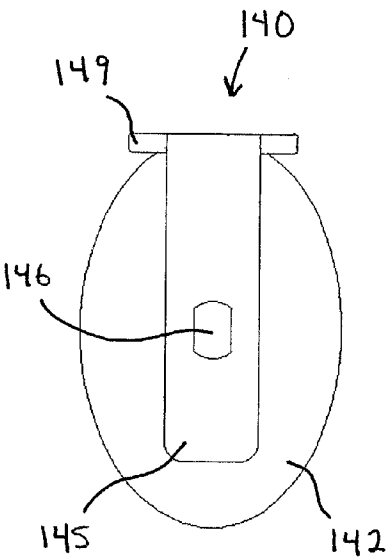
FIG. 20 is an outside end view of the bracket of FIG. 18.
Figure 18:
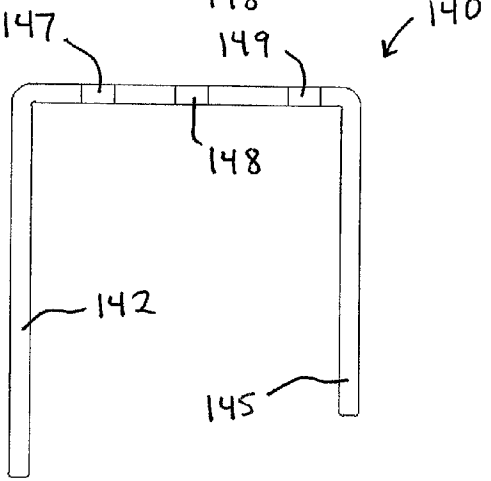
FIG. 18 is a side view of a bracket on the dumbbell of FIG. 1.
Figure 21:
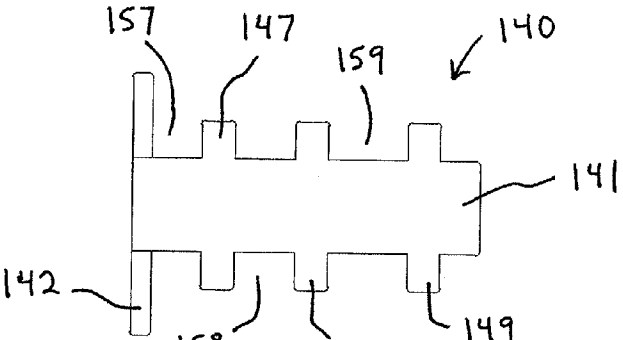
FIG. 21 is a top view of the bracket of FIG. 18.
Figure 19:
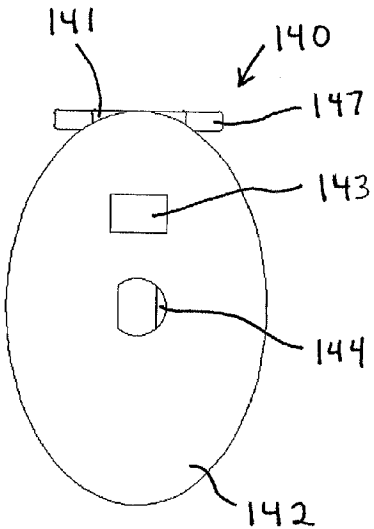
FIG. 19 is an inside end view of the bracket of FIG. 18.

In FIG. 13, the "10" on the indicator 160 is positioned to appear in the window 143, and none of the weight engagement members 167–169 has a lip portion positioned to underlie or hook a respective nub 208 (at 6:00). As a result, when the handle assembly 110 is lifted from the loaded base 300 shown in FIG. 2, all of the weight plates 227–229 remain at rest on the base 300. The "10" on the indicator 160 correctly indicates that the empty handle assembly 110 weighs ten pounds.

The indicator 160 and the weight engagement members 167–169 are rotated forty-five degrees counter-clockwise to arrive at the orientations shown in FIG. 14. The indicator 160 now displays a "20" in the window 143, and the weight engagement member 167 has a lip portion positioned to underlie a respective weight plate 227. With both weight engagement members 167 occupying this same orientation, both five pounds plates 227 are latched to the handle assembly 110. The "20" on the indicator 160 correctly indicates that the handle assembly 110 will now weigh twenty pounds when lifted from the base 300.

FIG. 15 shows that the next orientation engages the seven and one-half pound plates 228 while releasing the five pound plates 227. The "25" on the indicator 160 correctly indicates that the handle assembly 110 will now weigh twenty-five pounds when lifted from the base 300.

FIG. 16 shows that the next orientation engages the ten pound plates 229 while releasing the seven and one-half pound plates 228. The "30" on the indicator 160 correctly indicates that the handle assembly 110 will now weigh thirty pounds when lifted from the base 300.

FIG. 17 shows that the next orientation engages both the five pounds plates 227 and the seven and one-half pound plates 228 while releasing the ten pound plates 229. The "35" on the indicator 160 correctly indicates that the handle assembly 110 will now weigh thirty-five pounds when lifted from the base 300.

In the next orientation (not shown), the five pound plates 227 remain engaged, the seven and one-half pound plates 228 are released, and the ten pounds plates 229 are engaged. The "40" on the indicator 160 will correctly indicate that the handle assembly 110 is set to weight forty pounds when lifted from the base 300.

In the next orientation, the five pound plates 227 are released, the seven and one-half pound plates 228 are engaged, and the ten pounds plates 229 remain engaged. The "45" on the indicator 160 will correctly indicate that the handle assembly 110 is set to weigh forty-five pounds when lifted from the base 300.

In the last available orientation, all of the plates 227–229 are engaged, and the "55" on the indicator 160 will correctly indicate that the handle assembly 110 is set to weight fifty-five pounds when lifted from the base 300.

As shown in FIGS. 7–8, the weight engagement member 168 has three circumferentially spaced lig portions 186–188, and three circumferentially spaced gaps (one of which is designated as 189). The gap 189 spans an angle B of fifty degrees, and the lip portion 187 spans an angle A of forty degrees. As suggested by this example, two and one-half degrees of added "play" or tolerance are provided on each side of each gap to reduce the possibility of "snagging" a numb 208 on a weight plate that is not supposed to be selected.

In addition to engaging a desired combination of weight plates 227–229, each weight selector cooperates with a respective bracket 140 to maintain desired axial spacing of the weight plates 227–229. In this regard, the hub 182 on the weight engagement member 168 projects axially beyond the lip portions 186–188 to an extent that is slightly greater than the thickness of a weight plate 228. In other words, the hub 182 on the weight engagement member 168 is long enough to axially span both the lip portions 186–188 and one of the weight plates 228. As a result, the weight plates 228 is slidably retained between the lip portions 186–188 on the weight engagement member 168 and the disc portion 181 on an adjacent weight engagement member 167.

The weight engagement members 167 are generally similar to the weight engagement members 168, though their hubs are shorter (because the weight plates 227 are thinner), and their lip portions are arranged differently. The weight engagement members 169 are also generally similar to the weight engagement members 168. However, in addition to having longer hubs (because the weight plates 229 are thicker), and a different arrangement of lip portions, the weight engagement members 169 are preferably configured to function as knobs, as well. As a result, the weight engagement members 169 have a relatively greater thickness, which is measured axially, and the outside flange 145 on each bracket 140 is preferably configured to facilitate access to opposite sides of a respective knob 159. The outboard flanges 145 also protect against unintended rotation of the knob 169, particularly in cases where a user chooses to rest an end of the dumbbell 100 on his/her thigh.

The outer end walls 309 on the base 300 are notched like the inner end walls 307 to provide additional access to the knobs 169 when the dumbbell 100 is resting on the base 300. The inner end walls 307 are notched to accommodate the inside flanges 142 on respective brackets 140.

Recognizing that the weight selectors rotate to latch and unlatch the weight plates 227–229 relative to the handle assembly 110, the dumbbell 100 is preferably provided with one or more mechanisms to bias and/or lock the weight selectors against unintended rotation relative to the handle assembly 110. One such arrangement is provided on each end of the dumbbell 100 in FIG. 1. In particular, partially spherical depressions 119 extend into the outer surface of each knob 169 at locations spaced forty-five degrees apart from one another. A housing 116 is mounted within the upper outside corner of each bracket 140 immediately above a respective knob 169. A notch is preferably provided in the housing 116 to avoid potential interferences problems with the bend in the bracket 140. In a manner known in the art, a ball is movably mounted inside the housing 116 and allowed to project downward beyond the housing 116 and into an aligned depression 119 in the knob 169. A helical coil spring is compressed between the ball and either the overlying strip 141 on the bracket 140 or an upper portion of the housing 116. As a result of this arrangement, the knob 169 tends to click or snap into desired orientations relative to the handle assembly 110, and a threshold amount of torque is required to rotate the knob 169 out of any of these desired orientations. Other possible mechanisms include a leaf spring that deflects into and out of similar depressions, or a spring-biased lever that must first be moved to free the knob for rotation.

On the dumbbell 110, the two weight selectors operate independent of one another. In other words, the weight engagement members 167–169 at one end of the dumbbell 100 may be rotated to the orientation shown in FIG. 14, while the weight engagement members 167–169 at the other end of the dumbbell 100 remain in the orientation shown in FIG. 13. As a result, the opposite end weight indicators 160 will show "20" and "10", respectively, thereby correctly suggesting that the handle assembly 110 will weigh fifteen pounds (the average of ten and twenty) when lifted from the base 300. An advantage of this arrangement is that seven additional weight amounts may be selected. In other words, the dumbbell 100 provides eight different amounts of equally distributed weight, and seven additional amounts of weight that make one end of the dumbbell 100 somewhat heavier than the other end. To the extent that some people may find this imbalance undesirable, they can mitigate the effect by positioning the stronger, "thumb side" of their hand toward the heavier end, and/or adjusting their grip toward the heavier end. In any event, an advantage of the present invention is that relatively few weight plates are required to provide a relatively large number of effective dumbbell weights.

Another advantage associated with the dumbbell 100 involves the use of weight plates 227–229 that weigh five pounds, seven and one-half pounds, and ten pounds, respectively. Although the present invention is not limited in this regard, this particular combination strikes a seemingly desirable compromise between the range of available weights and the magnitude of adjustment between available weights. One alternative option is to use weight plates that weight two and one-half pounds, five pounds, and ten pounds, respectively. Together with a ten pound handle assembly, this combination would provide a range of ten to forty-five pounds in balanced five pound increments (assuming that the lip portions on the weight engagement members were rearranged to provide proper sequential selection of the weight amounts). In other words, this option provides generally the same magnitude of adjustment increments but with a maximum weight that is ten pounds lighter than the dumbbell 100. Another option is to use weight plates that weigh five pounds, ten pounds, and fifteen pounds, respectively. Together with a ten pound handle assembly, this combination would provide a range of ten to seventy pounds in balanced ten pound increments (again assuming that the lip portions on the weight engagement members were rearranged to provide proper sequential selection of the weight amounts). In other words, this option provides a greater maximum weight but with adjustment increments that are generally double those available with the dumbbell 100.

Many of the details associated with the dumbbell 100 may be modified or changed without departing from the scope of the present invention. Among other things, different amounts of weight, numbers of weight plates, and/or sizes of components may be substituted for those described above. This flexibility extends to the number of available weight selecting orientations, and/or choosing less than all of the possible combinations of weights. For example, the weight selectors may be reconfigured to select ten combinations of four weight plates at each end of the dumbbell, in a manner that provides smaller increments of change at the lower end of the available weight range while also providing a higher maximum weight. The following chart sets forth one possible example involving ten available amounts of balanced weight.

| Knob | Handle | 1st Weights | 2nd Weights | 3rd Weights | 4th Weights | Total |
|---|---|---|---|---|---|---|
| 0° | 10 | 0 | 0 | 0 | 0 | 10 |
| 36° | 10 | 5 | 0 | 0 | 0 | 15 |
| 72° | 10 | 0 | 10 | 0 | 0 | 20 |
| 108° | 10 | 5 | 10 | 0 | 0 | 25 |
| 144° | 10 | 0 | 0 | 20 | 0 | 30 |
| 180° | 10 | 0 | 10 | 20 | 0 | 40 |
| 216° | 10 | 0 | 10 | 0 | 30 | 50 |

-continued

| Knob | Handle | 1st Weights | 2nd Weights | 3rd Weights | 4th Weights | Total |
|---|---|---|---|---|---|---|
| 252° | 10 | 0 | 0 | 20 | 30 | 60 |
| 288° | 10 | 0 | 10 | 20 | 30 | 70 |
| 324° | 10 | 5 | 10 | 20 | 30 | 75 |

Another chart is set forth below to represent another desirable combination of weights. On this particular embodiment, the handle assembly is configured to weigh five pounds; the plates nearest the handle weigh six and one-quarter pounds each; the intermediate weights weigh two and one-half pounds each; and the outermost weights weigh one and one-quarter pounds each. By arranging one weight selector to select only the heaviest weight, and the other weight selector to select only the two lighter weights (see "Split" in the chart), an effective dumbbell weight of fifteen pounds is realized, and the selected weight will feel relatively well balanced because the relative distances between the selected weights and the center of the handle tend to produce offsetting moment arms. In other words, this particular arrangement of weights may be considered advantageous because it provides a ninth, "essentially balanced" weight amount and facilitates a desirable weight range from a marketing perspective.

| Knob | Handle | 1.25's | 2.5's | 6.25's | Total |
|---|---|---|---|---|---|
| 0° | 5 | 0 | 0 | 0 | 5.0 |
| 45° | 5 | 2.5 | 0 | 0 | 7.5 |
| 90° | 5 | 0 | 5 | 0 | 10.0 |
| 135° | 5 | 2.5 | 5 | 0 | 12.5 |
| Split | 5 | 1.25 | 2.5 | 6.25 | 15.0 |
| 180° | 5 | 0 | 0 | 12.5 | 17.5 |
| 225° | 5 | 2.5 | 0 | 12.5 | 20.0 |
| 270° | 5 | 0 | 5 | 12.5 | 22.5 |
| 315° | 5 | 2.5 | 5 | 12.5 | 25.0 |

Design flexibility exists with respect to various other elements, as well, including the location of the indicia for indicating the amount of selected weight, and/or the manner in which such indicia is provided. Also, alternative embodiments may be configured to accommodate knobs or other rotational aids in different locations, including just beyond each end of the handle, as opposed to just inside the distal ends of the dumbbell. Alternative embodiments may also include reconfigured weight engagement members which would, for example, have first and second lip portions that extend axially in opposite directions to selectively engage respective first and second weights on opposite sides of a respective weight engaging member.

Figure 28:
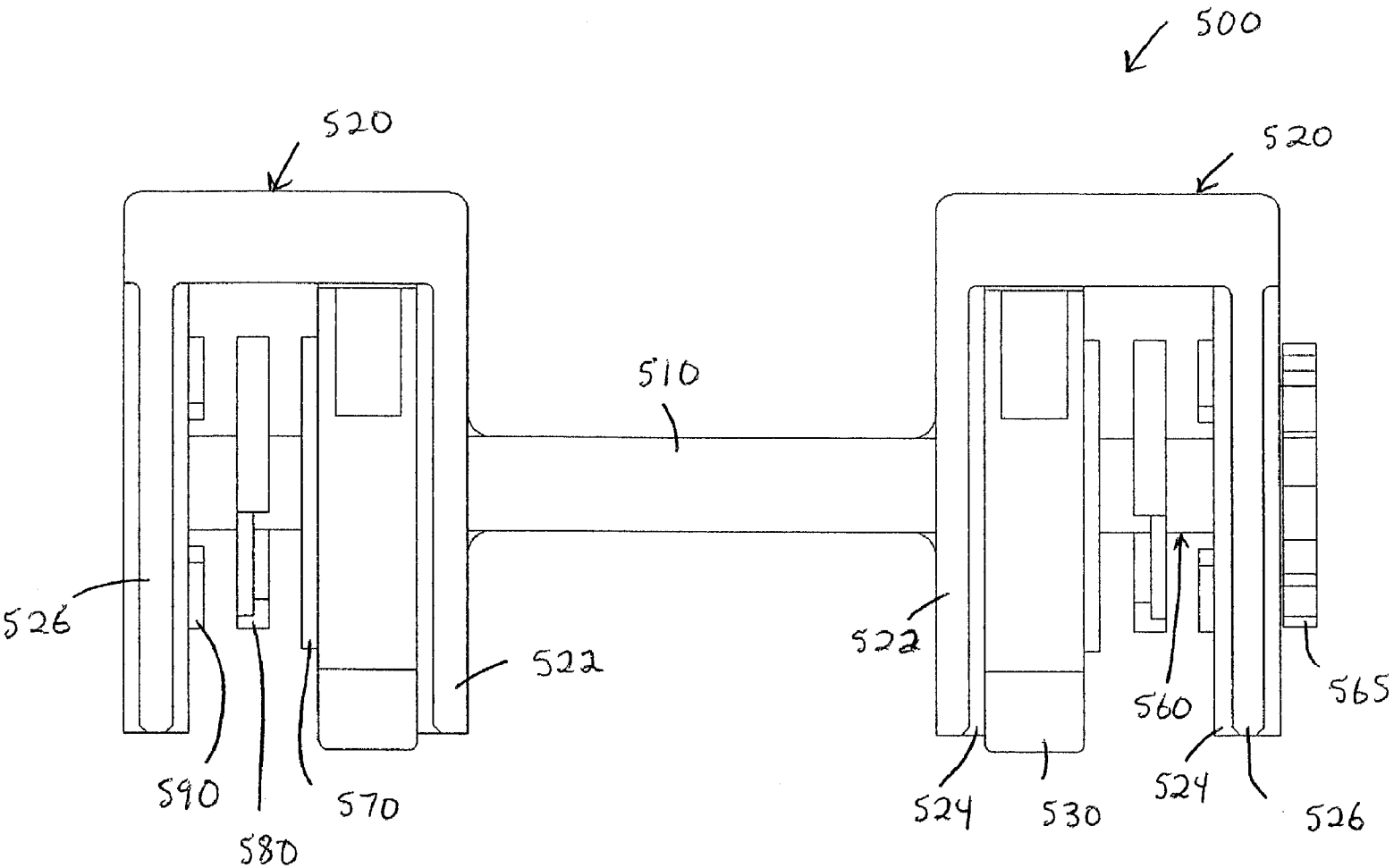
FIG. 28 is a side view of another exercise dumbbell constructed according to the principles of the present invention.
Figures 44, 45, 46:
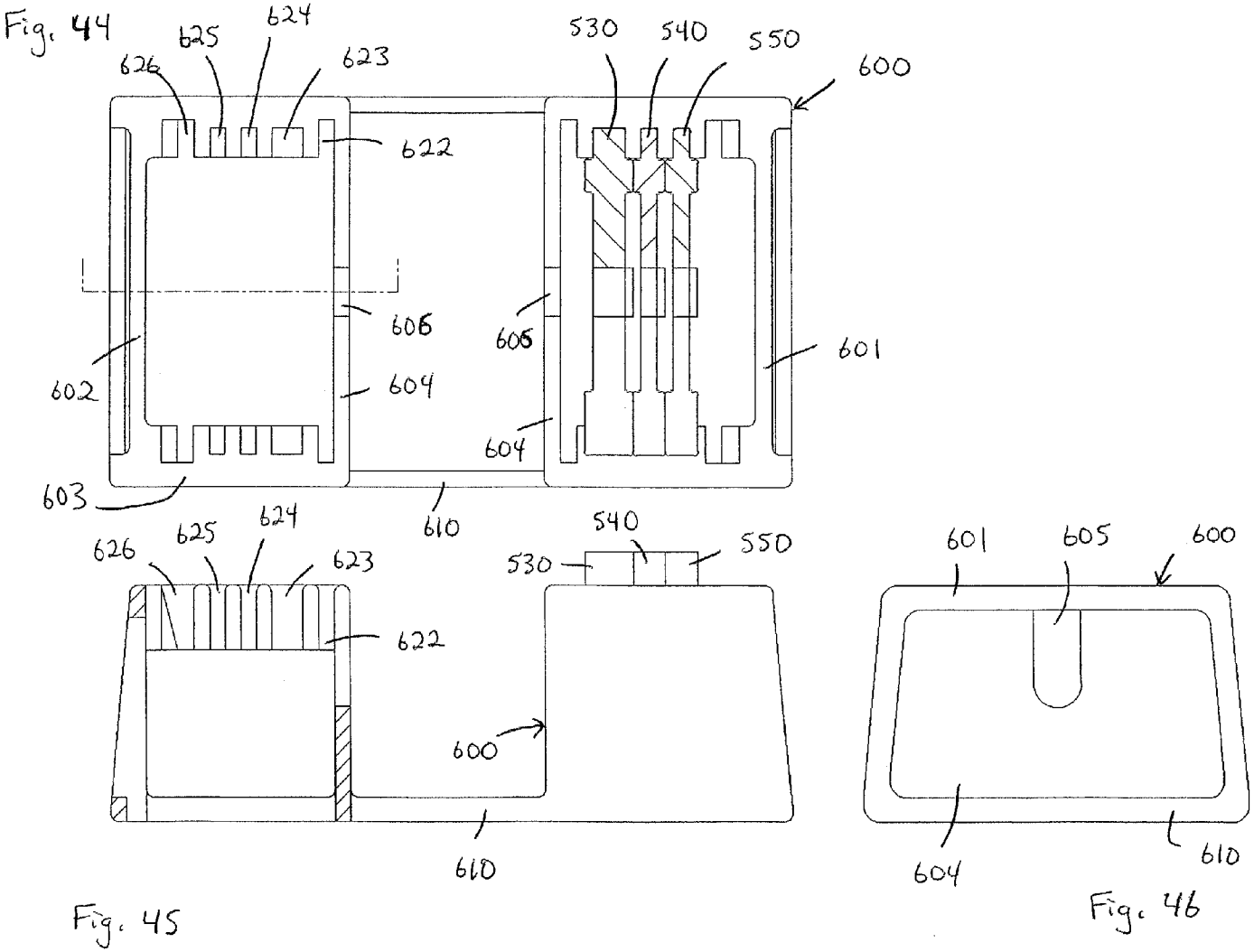
FIG. 44 is a partially sectioned top view of the weights of FIG. 40 resting on a cradle constructed according to the principles of the present invention.
FIG. 45 is a partially sectioned side view of the weights and cradle of FIG. 44.
FIG. 46 is an end view of the cradle of FIG. 44 without the weights.

Some of the possible variations of the present invention are embodied on an exercise dumbbell designated as 500 in FIG. 28. This dumbbell 500 has an intermediate handle 510 that is configured for grasping, and opposite end weight housings 520 that are configured to accommodate respective weight plates 530, 540, and 550. When not in use, the weight plates 530, 540, and 550 rest on a base or cradle designated as 600 in FIGS. 44–46.

The handle 510 is a cylindrical tube that is preferably made of steel. The handle 510 has a longitudinal axis and opposite ends secured to respective housings 520 (by welding or other suitable means). Each of the housings 520 includes an inside end wall 522, an outside end wall 526, a top wall 528, and opposite side walls 529, which cooperate to define a downwardly opening compartment. FIG. 28 shows integrally molded housings 520, and FIG. 29 shows a housing 520' which is identical in size and configuration, but assembled from three discrete parts. In either case, spacers may be provided to extend downward from the top wall 528 and occupy axial spaces between the weight plates 530, 540, and 550. Axially offset shoulders 524 are provided on interior, diametrically opposed sides of each end wall 522 and 526 to engage respective weights 530 and 550 and define centrally located gaps between the weights 530 and 550 and respective end walls 522 and 526. The shoulders 524 are disposed laterally inward from the outside edges of the walls 522 and 526.

A weight selector 560 is rotatably mounted relative to the handle 510 and/or the housings 520. The weight selector 560 includes a shaft 561 and two sets of weight engaging members or weight supports 570, 580, and 590 mounted on the shaft 561. The shaft 561 includes an intermediate portion 562 having a circular profile, and opposite end portions 563 having generally D-shaped profiles (a flat surface extends along an otherwise circular profile). The intermediate portion 562 extends through the handle 510 and through the inside end wall 522 of each housing 520. Each end portion 563 extends through a respective housing 520 and through a respective outside end wall 526.

Figure 34:
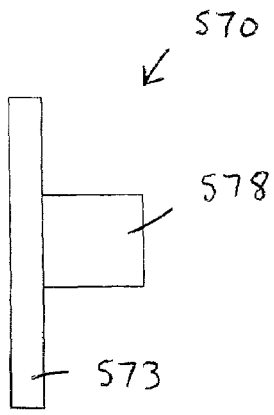
FIG. 34 is a side view of a first weight engaging member on the dumbbell of FIG. 28.
Figure 35:
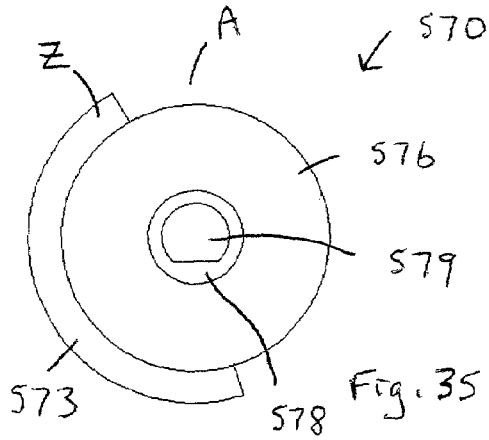
FIG. 35 is an end view of the weight engaging member of FIG. 34.

The innermost weight support 570 is shown by itself in FIGS. 34–35. The support 570 includes an axially extending hub 578, a radially extending rim 576, and an axially extending lip 573. The support 570 is preferably an injection molded plastic member, and the rim 576 may be said to be integrally connected between the lip 573 and the hub 578. An opening 579 extends through the hub 578 and the rim 576, and is configured to fit snugly onto an end 563 of the shaft 561. The lip 573 includes a single, continuous segment or hook that preferably extends through an arc of 167.5° The lip 573 spans a sector designated as Z in FIG. 35, but does not span the sector designated as A.

Figure 36:
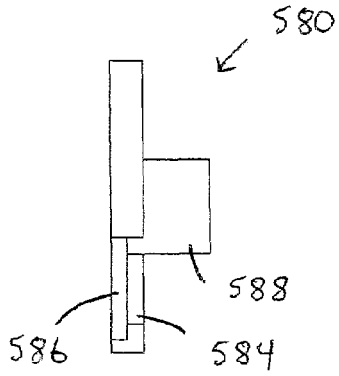
FIG. 36 is a side view of a second weight engaging member on the dumbbell of FIG. 28.
Figure 37:
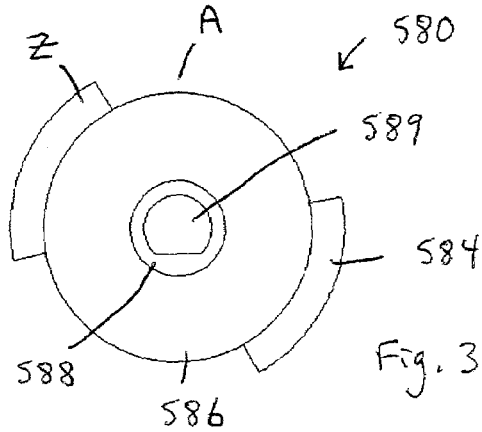
FIG. 37 is an end view of the weight engaging member of FIG. 36.
Figure 38:
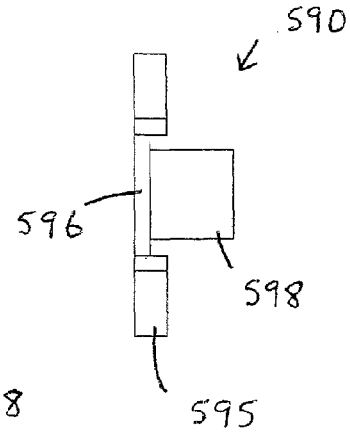
FIG. 38 is a side view of a third weight engaging member on the dumbbell of FIG. 28.

The intermediate weight support 580 is shown by itself in FIGS. 36–37. The support 580 includes an axially extending hub 588, a radially extending rim 586, and an axially extending lip 584. The support 580 is preferably an injection molded plastic member, and the rim 586 may be said to be integrally connected between the lip 583 and the hub 588. An opening 589 extends through the hub 588 and the rim 586, and is configured to fit snugly onto an end 563 of the shaft 561. The lip 583 includes two diametrically opposed segments or hooks that preferably extend through respective arcs of 77.5° One of the segments spans the sector designated as Z in FIG. 37, but neither of the segments spans the sector designated as A.

Figure 39:
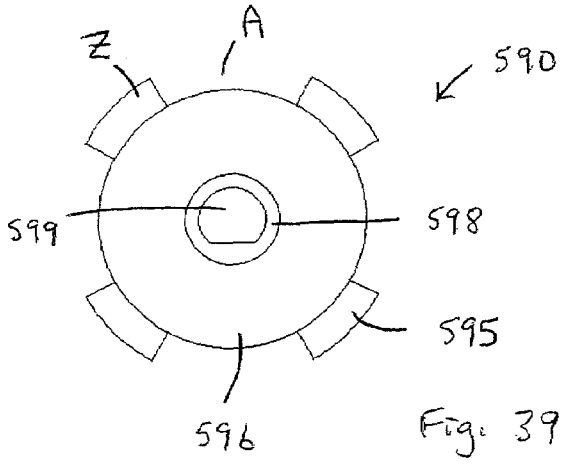
FIG. 39 is an end view of the weight engaging member of FIG. 38.
Figure 40:
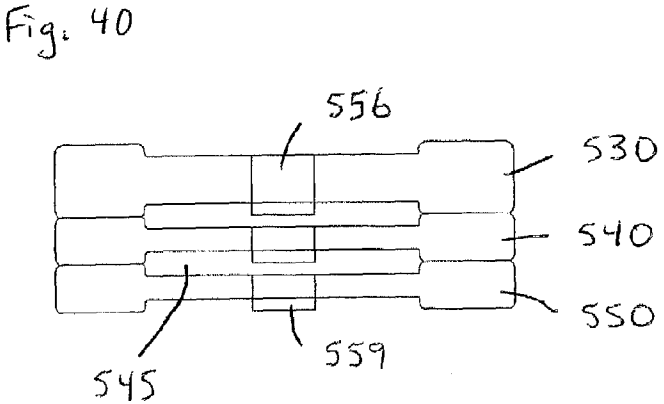
FIG. 40 is a top view of three adjacent weights on the dumbbell of FIG. 28.
Figure 48:
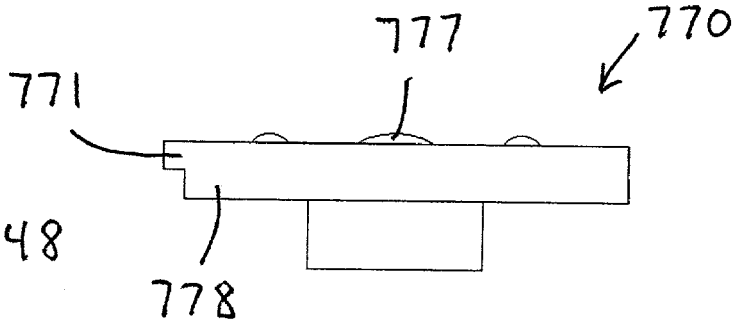
FIG. 48 is a side view of the weight engagement member of FIG. 47.
Figure 49:
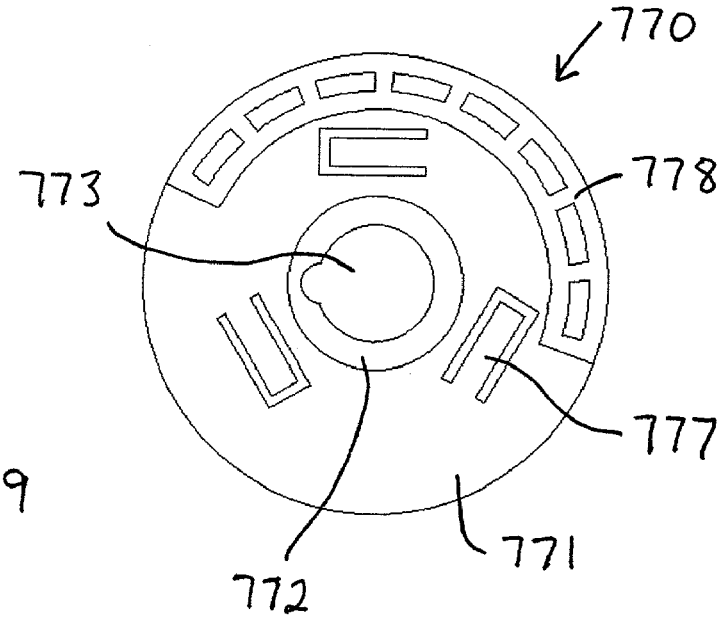
FIG. 49 is an opposite end view of the weight engagement member of FIG. 47.

The outermost weight support 590 is shown by itself in FIGS. 48–49. The support 590 includes an axially extending hub 598, a radially extending rim 596, and an axially extending lip 594. The support 590 is preferably an injection molded plastic member, and the rim 596 may be said to be integrally connected between the lip 593 and the hub 598. An opening 599 extends through the hub 598 and the rim 596, and is configured to fit snugly onto an end 563 of the shaft 561. The lip 593 includes four circumferentially spaced segments or hooks that preferably extend through respective arcs of 32.5° One of the segments spans the sector designated as Z in FIG. 39, but none of the segments spans the sector designated as A.

A fastener is secured to one end 563 of the shaft 561, just beyond an adjacent, outside end wall 526 of a respective housing 520, and a knob 565 is fastened to an opposite end 563 of the shaft 561 just beyond the outside end wall 526 of the other housing 520. As shown in FIGS. 30–31, the knob 565 includes a relatively large diameter rim 566 that is configured for grasping, an intermediate portion 567 that bears against the outside end wall 526, and a relatively small diameter hub 568 that extends through the outside end wall 526. A recess 506 is provided in the hub 568 to receive a fastener in countersunk fashion. Both the knob 565 and both sets of supports 570, 580, and 590 are constrained to rotate together with the shaft 560 relative to the housings 520 and the handle 510. In other words, unlike the dumbbell 110, the dumbbell 500 has first and second weight selectors that are constrained to rotate together relative to the handle 510.

Figure 41:
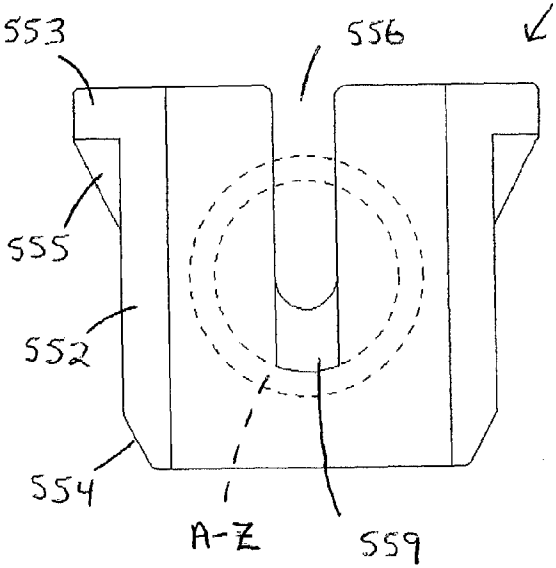
FIG. 41 is an end view of one of the weights of FIG. 40.
Figure 42:
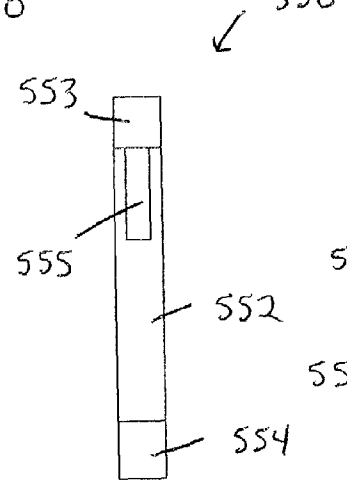
FIG. 42 is a side view of the weight of FIG. 41.
Figure 43:
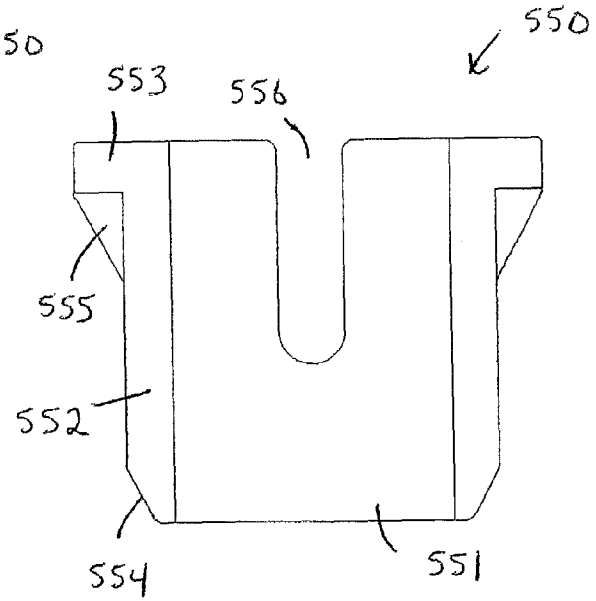
FIG. 43 is an opposite end view of the weight of FIG. 41.

The weight plates 530, 540, and 550 are shown in greater detail in FIGS. 40–43. Although the two plates 540 and 550 are shown with the same thickness, the plate 550 weighs one-half as much as the plate 540. The plate 550 may be made from a different density material and/or may be "cored out" to achieve the difference in mass vis-a-vis the plate 540. The plate 530 is configured to weigh twice as much as the plate 540. The end views of the plate 550 shown in FIGS. 41 and 43 are representative of the end views of the other plates 540 and 530.

Each side of the plate 550 (and the plates 540 and 530) may be described with reference to a relatively thinner, intermediate portion 551 and relatively thicker, opposite side portions 552. The side portions 552 bear against adjacent counterparts and/or against shoulders 524 on respective end walls 522 or 526 on the housings 520. The intermediate portion 551 cooperates with adjacent counterparts and/or the end walls 522 or 526 to define gaps 545 disposed between the side portions 552 and the shoulders 524. The gaps 545 are configured to receive respective weight engagement members 570, 580, and 590. FIG. 41 shows how the weight engagement members 590, 580, and 570 axially align with the plates 550, 540, and 530.

An elongate slot 556 extends downward into each of the plates 550, 540, and 530, and is configured to accommodate the axial hub 598, 588, and 578 on a respective support 590, 580, or 570. Just beneath the slot 556, a nub or peg 559 projects axially outward from the intermediate portion 551 of the plate 550 (and each of the plates 540 and 530). The peg 559 is disposed just inside the path A–Z traveled by the axially extending lip 595 on the support 590. As on the dumbbell 100, when a segment of the lip 595 is disposed beneath the peg 559, the plate 550 is "hooked" or constrained to move upward together with the handle 510.

The upper ends of the side portions 552 terminate in respective laterally extending portions 553, which extend away from one another. The lateral portions 553 are the same thickness as the side portions 552. The lower ends 554 of the side portions 552 are beveled or tapered. Relatively thinner, triangular fins 555 extend between respective lateral portions 553 and respective side portions 552. The fins 555 are configured to fit within opposing slots 625 in the base 600, and the lateral portions 553 are designed to rest on top of the ledge 603. Similar fins 555 on the plates 540 and 530 are configured to fit within respective slots 624 and 623 in the base 600. The grooves 623–625 are bounded by inclined, opposing walls which cooperate to center the plates 530, 540, and 550 relative to the base 600. Additional grooves 622 and 626 are provided in the base 600 to receive the end walls 522 and 526, respectively. The grooves 626 are bounded by relatively outward walls which are inclined upward and away from the middle of the base 600.

The base 600 has a bottom 610 that is configured to rest upon a flat surface, such as a table top or floor. Opposite end portions 601 and 602 extend upward from the bottom 610.

In addition to outside walls, interior walls 604 extend upward from the bottom 610 and between opposing end walls 522 on respective housings 520. Elongate slots 606 extend downward into the interior walls 604 to accommodate the handle 510. When the plates 530, 540, and 550 are suspended from the base 600, the slots 606 align with the slots 556.

As on the dumbbell 100, the weight selector 560 is designed for rotation in 45° increments, but as discussed above, the present invention is not strictly limited in this regard. Also, a ball detent or other biasing system may be interconnected between the housing 520 and either the knob 565 or the weight selector shaft 561, for example, to bias the weight selector 560 to enter into and remain in the desired orientations.

The lips 573, 584, and 595 are configured to provide a wide berth or an added margin of clearance vis-a-vis the pegs 559. In particular, when any given plate 530, 540, or 550 is not engaged, the respective lip 573, 584, or 595 is at least 6° outside the boundary of the peg 559. With reference to the support 590, for example, each of the lip segments 595 spans an arc of 32.5°.

The configuration of the weight supports 570, 580, and 590, as well as the plates 530, 540, and 550, are such that any combination of the plates 530, 540, and 550 may be secured to the handle 510 for removal from the base 600. In this regard, when the support 570, 580, and 590 occupy the respective orientations shown in FIGS. 35, 37, and 39, the plates 530 are engaged to the exclusion of the plates 540 and 550. When the supports 570, 580, and 590 are rotated 180°, the sector designated as A underlies the pegs 559 on the plates 530, 540, and 550, and none is secured to the handle 510. When the supports 570, 580, and 590 are rotated until the sector designated as Z underlies the pegs 559, all of the plates 530, 540, and 550 are engaged.

With the handle 510 and the housings 520 designed to collectively weigh ten pounds, and the plates 530, 540, and 550 weighing ten pounds, five pounds, and two and one-half pounds, respectively, the following chart shows how different amounts of weight may be selected as a function of the orientation of the weight selector 560.

| Knob | Handle | Weights 590 | Weights 580 | Weights 570 | Total |
|---|---|---|---|---|---|
| — | 10 | 0 | 0 | 0 | 10 |
| 45° | 10 | 5 | 0 | 0 | 15 |
| 90° | 10 | 0 | 10 | 0 | 20 |
| 135° | 10 | 5 | 10 | 0 | 25 |
| 180° | 10 | 0 | 0 | 20 | 30 |
| 225° | 10 | 5 | 0 | 10 | 35 |
| 270° | 10 | 0 | 10 | 20 | 40 |
| 315° | 10 | 5 | 10 | 20 | 45 |

Like the dumbbell 100, the dumbbell 500 requires only three discrete weights at each end to provide eight different balanced dumbbell loads. Unlike the dumbbell 100, balanced adjustments to the effective weight of the dumbbell 500 may be made by rotating a single knob. Although the unitary weight selector 560 does not accommodate additional, out of balance weight amounts, the number of available dumbbell loads may be doubled by selectively adding opposite end "half-weights" that weight one-half as much as the plates 590. For example, such half-weights could be connected to the inside end walls 522 by means of hook and loop fasteners or spring clips.

Figure 47:
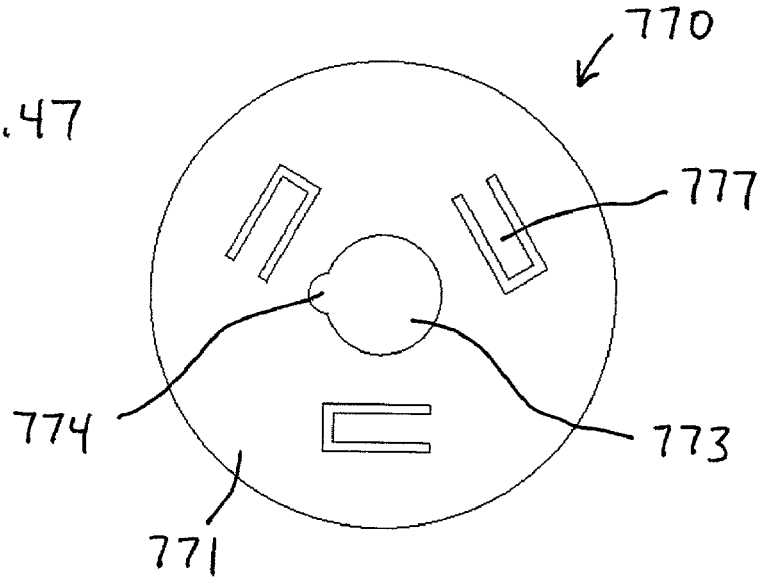
FIG. 47 is an end view of an alternative embodiment weight engagement member suitable for use in accordance with the present invention.

As noted above with respect to the dumbbell 100, several of the details concerning the dumbbell 500 may be modified without departing from the scope of the present invention. Among other things, many of the features and variations discussed above with reference to the dumbbell 100 are applicable to the dumbbell 500, and vice versa. Still another possible modification is depicted on an alternative embodiment weight engagement member designated as 770 in FIGS. 47–49.

Like the weight engagement members on the dumbbells 100 and 500, the weight engagement member 770 includes a radially extending disc portion 771, an axially extending hub portion 772, and at least one axially extending lip portion 778. As shown in FIG. 49, small openings may be provided in the lip portion 778 to improve the strength-to-mass ratio of the part. A cylindrical hole 773 extends through the hub portion 772 and the disc portion 771 to facilitate rotatable mounting of the weight engagement member 770 on a cylindrical shaft. Also, a groove or keyway 774 cooperates with the hole 773 to facilitate keying of the weight engagement member 770 on a cylindrical shaft (in the alternative). Circumferentially spaced leaf springs 777 are integrally formed in the disc portion 771 of the weight engagement member 770. As shown in FIG. 48, the intermediate portion of each leaf spring 777 projects axially beyond the disc portion 771, in a direction opposite the hub portion 772. The purpose of these springs 777 is to "take up" or span any gap between the disc portion 771 and the weight plate that may be caused due to tolerances in the manufacturing process, and/or to impose a clamping force against an adjacent weight plate. In any event, leaf springs 777 must be configured in a manner that any associated clamping and/or friction forces do not cause "unselected" weight plates to rise from the base together with the handle assembly.

The present invention may also be described in terms of various methods of providing adjustable mass to resist exercise motion. Many such methods may be described with reference to the foregoing embodiments. For reasons of practicalilty, the foregoing description and accompanying figures are necessarily limited to only some of the many conceivable embodiments and applications of the present invention. Other embodiments, improvements, and/or modifications will become apparent to those skilled in the art as a result of this disclosure. Moreover, those skilled in the art will also recognize that aspects and/or features of various methods and/or embodiments may be mixed and matched in numerous ways to arrive at still more variations of the present invention. In view of the foregoing, the scope of the present invention is to be limited only to the extent of the following claims.

What is claimed is:

1. An adjustable mass free weight system, comprising:

a handle assembly including a hand grip, a first weight selector disposed at a first end of said hand grip, and a second weight selector disposed at an opposite, second end of said hand grip, wherein each said weight selector is rotatably connected to said hand grip, and each said weight selector includes (a) a base portion that defines a longitudinal axis, (b) radial portions that are affixed to said base portion at axially spaced locations and extend radially away from said base portion, and (c) axial portions that are affixed to radially outward ends of respective radial portions and extend axially away from respective radial portions;

a plurality of aligned weights, wherein slots in the weights are configured to receive said base portion, and gaps are defined between adjacent weights to receive respective radial portions and axial portions therebetween, and each of said weights has a nub that projects axially toward a respective one of said radial portions and is selectively engaged when a respective one of said axial portions is rotated beneath said nub; and a base configured to support said weights in a rest position.

2. The system of claim 1, wherein each of said weights has an axially extending shoulder that spans a respective one of said gaps.

3. The system of claim 1, wherein said first weight selector is rotatable relative to said second weight selector.

4. The system of claim 1, wherein opposite end portions of a bar project outward from respective ends of said hand grip, and each said base portion forms a tube about a respective one of said end portions.

5. The system of claim 1, wherein each said base portion is keyed to a common bar that extends through said hand grip.

6. The system of claim 1, wherein each said weight selector is rotatable to a first orientation relative to said weights, wherein only first said weights at respective ends of said hand grip are engaged by respective axial portions, and each said weight selector is rotatable to a second orientation relative to said weights, wherein only second said weights at respective ends of said hand grip are engaged by respective axial portions.

7. The system of claim 6, wherein each said weight selector is rotatable to a third orientation relative to said weights, wherein both said first weights and said second weights are engaged by respective axial portions.

8. The system of claim 1, wherein at least one of said radial portions supports at least two said axial portions that are circumferentially spaced apart from one another.

9. The system of claim 1, wherein at least one of said radial portions supports at least three said axial portions that are circumferentially spaced apart from one another.

10. The system of claim 1, wherein said weights have lower ends that are configured to fit into respective slots in said base, and transversely extending shoulders that are configured to rest on opposite sidewalls on said base.

11. An adjustable mass free weight system, comprising:

a hand grip;

at least one weight selector that defines a longitudinal axis and is rotatably connected to said hand grip, wherein a plurality of discrete engagement members are affixed to each said weight selector at discrete axially spaced locations, and each of said members includes a radially extending segment and at least one axially extending segment affixed to a radially outward portion of said radially extending segment;

a plurality of weights, wherein each of said weights has a slot that is configured to receive a respective said weight selector, and adjacent said weights define gaps therebetween to accommodate respective members, and each of said weights has an axially extending nub that is disposed radially inside a rotational path defined by each said axially extending segment on a respective one of said members, and said at least one weight selector rotates relative to said weights to move each said axially extending segment into and out of underlying engagement with a respective nub; and a base configured to support said weights in a rest position.

12. The system of claim 11, wherein said at least one weight selector is rotatable to a first orientation relative to said weights, wherein only a first one of said weights is engaged, and said at least one weight selector is rotatable to a second orientation relative to said weights, wherein a second one of said weights is engaged.

13. The system of claim 12, wherein said at least one weight selector is rotatable to a third orientation relative to said weights, wherein both said first one of said weights is engaged by a respective axially extending segment, and said second one of said weights is engaged by a respective axially extending segment.

14. The system of claim 11, wherein opposite end portions of a bar project outward from respective ends of said hand grip, and said at least one weight selector includes first and second weight selectors rotatably mounted on respective end portions of said bar and rotatable independent of one another.

15. The system of claim 11, wherein said weights have lower ends that are configured to fit into respective slots in said base, and transversely extending shoulders that are configured to rest on opposite sidewalls on said base.

16. An adjustable mass free weight system, comprising:

a bar having an intermediate handle portion, a first end portion, and an opposite, second end portion, wherein said bar defines a longitudinal axis;

a first weight plate and a second weight plate maintained in axial alignment along said first end portion of said bar;

a third weight plate and a fourth weight plate maintained in axial alignment along said second portion of said bar, wherein each said weight plate includes an axially extending nub;

a first weight selector and a second weight selector, wherein each said weight selector is rotatably mounted on a respective end portion of said bar, and said first weight selector includes at least one dedicated hook for each of said first weight plate and said second weight plate, and said second weight selector includes at least one dedicated hook for each of said third weight plate and said fourth weight plate, and each said hook is configured to engage and disengage a respective said nub as a function of its orientation relative to said bar, and each said hook on said first weight selector is constrained to rotate together, and each said hook on said second weight selector is constrained to rotate together; and a base configured to support said weights in a rest position.

17. The system of claim 16, wherein a first bracket is secured to said first end portion of said bar, and a second bracket is secured to said second end portion of said bar, and each said bracket bounds a distal end of a respective weight selector.

18. The system of claim 16, wherein a first bracket is secured to said first end portion of said bar, and a second bracket is secured to said second end portion of said bar, and each said bracket has a U-shaped configuration with opposite distal ends connected to said bar and an intermediate portion spanning a respective weight selector.

19. The system of claim 16, wherein a first bracket is secured to said first end portion of said bar, and a second bracket is secured to said second end portion of said bar, and each said bracket has a U-shaped configuration with opposite distal ends connected to said bar, and a respective weight selector disposed therebetween.

20. The system of claim 16, wherein each said weight plate has a lower end that is configured to fit into a respective slot in said base, and transversely extending shoulders that are configured to rest on opposite sidewalls on said base.

21. An adjustable mass free weight system, comprising:

a handle having a first end and a second end;

a plurality of first weights maintained in axial alignment at said first end of said handle;

a plurality of second weights maintained in axial alignment at said second end of said handle;

a base configured to support said first weights and said second weights in a rest position; and a first means, rotatably connected to said first end of said handle, for selectively securing said first weights to said handle and for maintaining spacing between adjacent said first weights, wherein said first means is rotatable from a first orientation, wherein only one of said first weights is secured to said handle, to a second orientation, wherein another of said first weights is secured to said handle; and a second means, rotatably connected to said second end of said handle, for selectively securing said second weights to said handle and for maintaining spacing between adjacent said second weights, wherein said second means is rotatable from a first orientation, wherein only one of said second weights is secured to said handle, to a second orientation, wherein another of said second weights is secured to said handle.

* * * * *

UNITED STATES PATENT AND TRADEMARK OFFICE

CERTIFICATE OF CORRECTION

PATENT NO. : 7,077,791 B2
APPLICATION NO. : 10/127049
DATED : July 18, 2006
INVENTOR(S) : Mark A. Krull It is certified that error appears in the above-identified patent and that said Letters Patent is hereby corrected as shown below:

Title page, Item (73), Assignee: delete "Mautilus, Inc." and insert --Nautilus, Inc.--.

Signed and Sealed this

Seventh Day of November, 2006

JON W. DUDAS
*Director of the United States Patent and Trademark Office*